US009023562B2

(12) United States Patent
Ueno et al.

(10) Patent No.: US 9,023,562 B2
(45) Date of Patent: May 5, 2015

(54) ELECTROPHOTOGRAPHIC PHOTORECEPTOR

(71) Applicant: Fuji Electric Co., Ltd., Kawasaki-shi (JP)

(72) Inventors: Takashi Ueno, Matsumoto (JP); Yuji Ogawa, Matsumoto (JP); Keiichi Kurokawa, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 0 days.

(21) Appl. No.: 14/050,895

(22) Filed: Oct. 10, 2013

(65) Prior Publication Data

US 2014/0127618 A1 May 8, 2014

(30) Foreign Application Priority Data

Nov. 8, 2012 (JP) ..... 2012-246094

(51) Int. Cl.
*G03G 5/06* (2006.01)

(52) U.S. Cl.
CPC ..... *G03G 5/0614* (2013.01); *G03G 5/0666* (2013.01); *G03G 5/0696* (2013.01)

(58) Field of Classification Search
CPC ..... G03G 5/0696; G03G 5/0614
USPC ..... 430/78, 73, 74, 59.5, 58.65, 58.85
See application file for complete search history.

(56) References Cited

U.S. PATENT DOCUMENTS 5,736,282 A * 4/1998 Tamura et al. ..... 430/58.45

FOREIGN PATENT DOCUMENTS

EP 0504794 A1 * 3/1992
JP H03-196049 A 8/1991

(Continued)

OTHER PUBLICATIONS

English language machine translation of JP 2011-164455 (Aug. 2011).*

*Primary Examiner* — Christopher Rodee
(74) *Attorney, Agent, or Firm* — Rabin & Berdo, P.C.

(57) ABSTRACT

An electrophotographic photoreceptor includes a conductive substrate; and a photosensitive layer provided on the conductive substrate that includes an organic photoconductive material and charge transport materials including a styryl compound represented by structural formula (I) below and a triphenylamine compound represented by structural formula (II) below:

(I)

(II)

wherein the charge transport materials have a mixing ratio of from 8.33 to 16.67 mass % of the styryl compound to from 91.67 to 83.33 mass % of the triphenylamine compound.

2 Claims, 4 Drawing Sheets

(56) References Cited

FOREIGN PATENT DOCUMENTS

| | | | | |
|---|---|---|---|---|
| JP | 08209023 | A | * | 8/1996 |
| JP | H09-90654 | A | | 4/1997 |
| JP | H11-84696 | A | | 3/1999 |
| JP | 2001-051434 | A | | 2/2001 |
| JP | 2011164455 | A | * | 8/2011 |
| WO | WO 2012050143 | A1 | * | 4/2012 |

* cited by examiner

ELECTROPHOTOGRAPHIC PHOTORECEPTOR

CROSS-REFERENCE TO RELATED APPLICATION

This non-provisional application claims the benefit of the priority of Applicant's earlier filed Japanese Patent Application Laid-open No. 2012-246094 filed Nov. 8, 2012, the entire contents of which are incorporated herein by reference.

BACKGROUND OF THE INVENTION

1. Field of the Invention

The present invention relates to an electrophotographic photoreceptor (hereunder sometimes called simply a "photoreceptor"), and relates specifically to an electrophotographic photoreceptor provided with a photosensitive layer containing an organic photoconductive material on a conductive substrate, for use in electrophotographic printers, copiers, fax machines and the like.

2. Description of the Related Art

Conventionally, the principal type of electrophotographic photoreceptor has been the inorganic photoreceptor, which is provided with a photosensitive layer of an inorganic photoconductive substance such as selenium or selenium alloy or a photosensitive layer of a material containing an inorganic photoconductive substance such as zinc oxide or cadmium sulfide dispersed in a resin binder. Because of advantages such as flexibility, thermal stability, and film formation, however, organic photoreceptors have been developed in recent years provided with photosensitive layers of organic materials including organic photoconductive materials. Examples include photoreceptors having photosensitive layers composed of poly-N-vinylcarbazole and 2,4,7-trinitrofluorene-9-one, photoreceptors composed primarily of organic pigments, and photoreceptors having photosensitive layers composed primarily of eutectic complexes of dyes and resins.

A photoreceptor must have the function of holding a surface charge in the dark, the function of receiving light and generating charge carriers, and the function of receiving light and transporting charge carriers. These photoreceptors include monolayer photoreceptors, which combine all these functions in a single layer, and functionally separated stacked photoreceptors, which are obtained by stacking functionally discrete layers: primarily, a layer that contributes to generating charge carriers during photoreception, and a layer that contributes to holding a surface charge in the dark and transporting charge carriers during photoreception.

Of these, functionally separated stacked photoreceptors have recently come to predominate. In particular, there have been many proposals for negatively-charged photoreceptors in which the photosensitive layer includes a charge generation layer using an organic pigment as the charge generation material, which is either vapor deposited or dispersed in a resin binder together with a solvent to obtain a coating solution which is then coated to form the charge generation layer, laminated with a charge transport layer using an organic low-molecular-weight compound as the charge transport material, which is dispersed in a resin binder together with a solvent to obtain a coating liquid which is then coated to form the charge transport layer.

For example, phthalocyanine pigments and azo pigments, anthanthrone pigments, perylene pigments, perinone pigments, squarilium pigments, thiapyrylium pigments, quinacridone pigments and other organic pigments are known as charge generation materials. Moreover, pyrazoline compounds and pyrazolone compounds, hydrazone compounds, oxadiazole compounds, arylamine compounds, benzidine compounds, styryl compounds, butadiene compounds, terephthalic acid compounds and other organic low-molecular-weight compounds are known as charge transport materials.

For example, in the technique disclosed in Japanese Patent Application Publication No. H9-90654 an azo compound having a specific structure is included together with a triarylamine compound and/or distyryl compound in the photosensitive layer in order to provide an electrophotographic photoreceptor having high sensitivity, durability and repeat stability. Moreover, Japanese Patent Application Publication No. H3-196049 discloses an electrophotographic photoreceptor using a stilbene compound with a specific structure and a triphenylamine compound with a specific structure as charge transport materials. Furthermore, Japanese Patent Application Publication No. 2001-51434 discloses an electrophotographic photoreceptor using a triphenylamine compound with a specific structure as a charge transport material, while Japanese Patent Application Publication No. H11-84696 discloses an electrophotographic photoreceptor containing a hydrazone compound with a specific structure, a butadiene compound with a specific structure and a styryl compound with a specific structure as charge transport materials.

However, although photoreceptors using triphenylamine compounds as charge transport materials have excellent wear resistance, gradation and solvent crack resistance, as well as the advantage of low cost in comparison with other charge transport materials, they have also been vulnerable to light-induced fatigue among other problems.

That is, when the drum cartridge is left in a detached state before being mounted on the electrophotographic device, light from fluorescent lamps and the like used in interior lighting may shine on areas of the photoreceptor surface through gaps in the light-receiving part of the cartridge and the like. This causes light-induced fatigue of the areas exposed to light, which may result in problems of abnormal printing concentration in these areas when the cartridge is mounted on an electrophotographic device and used in printing.

It is therefore an object of the present invention to resolve the aforementioned problems and provide a good electrophotographic photoreceptor whereby costs can be controlled while reducing light-induced fatigue.

SUMMARY OF THE INVENTION

The inventors in this case discovered as a result of exhaustive research that the aforementioned problems could be resolved by using a styryl compound with a specific structure and a triphenylamine compound with a specific structure together as charge transport materials, thereby perfecting the invention.

That is, the present invention features an electrophotographic photoreceptor, comprising a conductive substrate; and a photosensitive layer provided on the conductive substrate and comprised of an organic photoconductive material, and charge transport materials including a styryl compound represented by structural formula (I) below and a triphenylamine compound represented by structural formula (II) below:

(I)

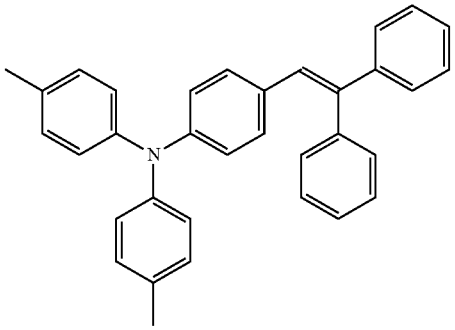

(II)

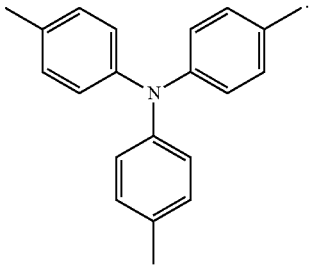

In the photoreceptor of the present invention, the charge transport materials preferably have a mixing ratio of from 1.25 to 50.0 mass % of the styryl compound represented by structural formula (I) to from 98.75 to 50.0 mass % of the triphenylamine compound represented by structural formula (II) above. More preferably, the charge transport materials have a mixing ratio of from 8.33 to 16.67 mass % of the styryl compound represented by structural formula (I) above to from 91.67 to 83.33 mass % of the triphenylamine compound represented by structural formula (II) above. Moreover, the photosensitive layer may further comprise a charge generation material comprised of titanyl phthalocyanine having clear diffraction peaks at Bragg angles of 7.22°, 9.60°, 11.60°, 13.40°, 14.88°, 18.34°, 23.62°, 24.14° and 27.32° in the CuKα X-ray diffraction spectrum, and having a maximum diffraction peak at a Bragg angle of 9.60°.

By mixing and combining the two compounds described above as charge transport materials in the present invention, it is possible to compensate for the defects that occur using either substance alone, and achieve a good electrophotographic photoreceptor with little light-induced fatigue while controlling costs. As discussed above, techniques are already known for using triphenylamine compounds and styryl compounds either alone or together as charge transport materials, but in all these cases the problems to be resolved are different from those of the present invention, which deals with improvements in light-induced fatigue resistance. Specifically, the combined use of the styryl compound with a specific structure and triphenylamine compound with a specific structure in the present invention and the superior effects in terms of improving light-induced fatigue resistance have not been known in the past.

DETAILED DESCRIPTION OF THE INVENTION

Embodiments of the present invention are explained in detail below with reference to the drawings.

Figure 1:
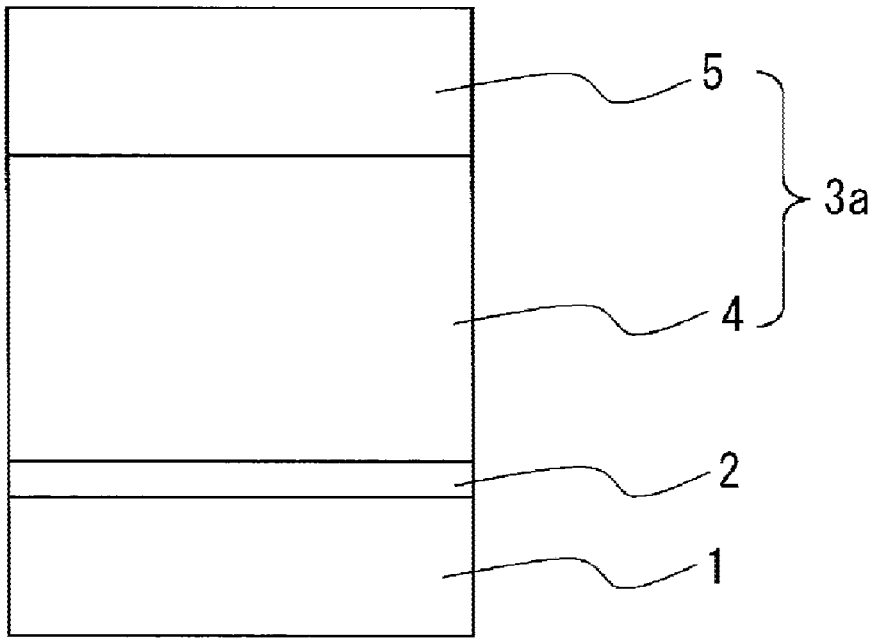
FIG. 1 is a cross-sectional view of one configuration example of the electrophotographic photoreceptor of the invention.
Figure 2:
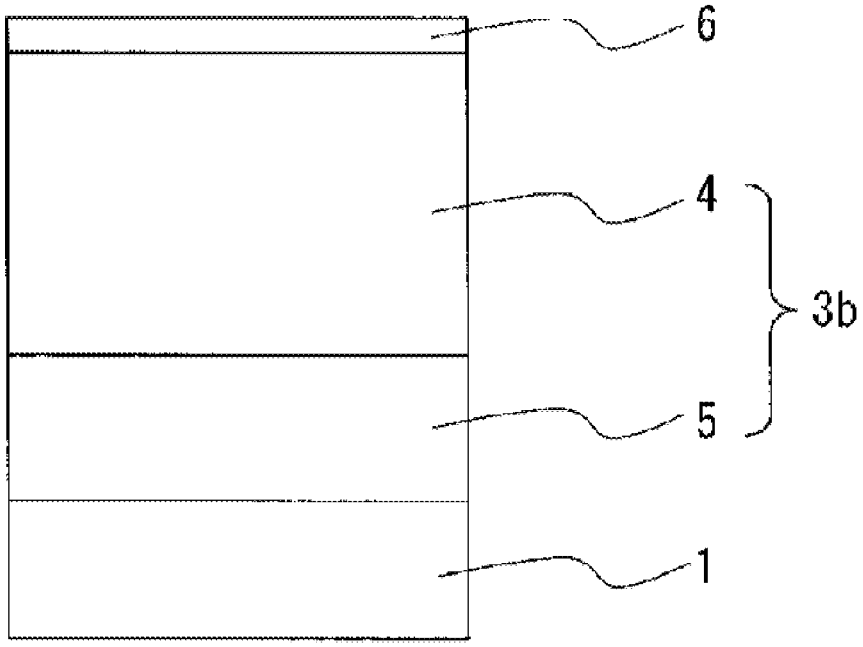
FIG. 2 is a cross-sectional view of another configuration example of the electrophotographic photoreceptor of the invention.
Figure 3:
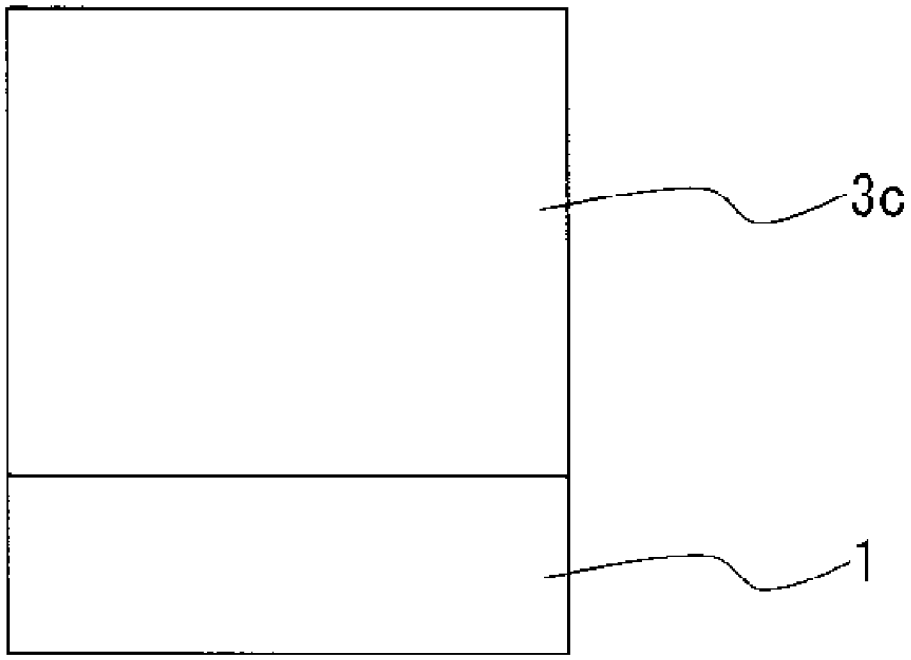
FIG. 3 is a cross-sectional view of yet another configuration example of the electrophotographic photoreceptor of the invention.

FIG. 1 is a cross-sectional view of one configuration example of the electrophotographic photoreceptor of the invention, which is a negatively-charged functionally separated stacked photoreceptor provided with a photosensitive layer 3*a* including a charge generation layer 4 and a charge transport layer 5 stacked in that order on a conductive substrate 1 with an undercoat layer 2 between the photosensitive layer and the substrate. FIG. 2 is a cross-sectional view of a different configuration example of the photoreceptor of the present invention, which is a positively-charged functionally separated stacked photoreceptor provided with a photosensitive layer 3*b* including a charge transport layer 5 and a charge generation layer 4 stacked in that order on a conductive substrate 1, and also having a surface protective layer 6. FIG. 3 is a cross-sectional view of yet another configuration example of the photoreceptor of the present invention, which is a normally positively-charged, monolayer photoreceptor provided with a monolayer photosensitive layer 3*c* containing a mixture of a charge generation material and a charge transport material on a conductive substrate 1. In all these types of photoreceptors, an undercoat layer 2 and surface protective layer 6 may be provided as necessary. Moreover, in the present invention a "photosensitive layer" may be either a stacked photosensitive layer obtained by stacking a charge generation layer and a charge transport layer, or a monolayer photosensitive layer.

In any of these configurations of the present invention, including a styryl compound represented by structural formula (I) above and a triphenylamine compound represented by structural formula (II) above as charge transport materials in the photosensitive layer is critical for obtaining the specific effects of the invention. That is, as discussed above, while problems such as vulnerability to light-induced fatigue have occurred in photoreceptors using triphenylamine compounds as a charge transport materials, this problem can be resolved by combining this with a styryl compound. Moreover, because the amount of the expensive styryl compound can be controlled in the present invention by combining it with a triphenylamine compound in the present invention, a photoreceptor without problems of light-induced fatigue can be obtained while maintaining cost benefits.

Regarding the respective contents of these charge transport materials, the content of the styryl compound is preferably 1.25 to 50.0 mass % and the content of the triphenylamine compound is preferably 98.75 to 50.0 mass % of the charge transport materials contained in the photosensitive layer. If the content of the styryl compound is less than 1.25 mass % the problem of light-induced fatigue will not be sufficiently improved, while if it exceeds 50.0 mass % there is a tendency towards positive memory, and costs are increased. Positive memory here means a phenomenon attributable to light-induced fatigue of the photoreceptor surface caused by fluorescent light or the like as discussed above, in which a pattern with a higher concentration than the surrounding image appears in an area of fatigue when the photoreceptor is installed in an electrophotographic device and used to print a solid or half-tone image. On the other hand, negative memory is a phenomenon in which a pattern with a lower concentration than the surrounding image appears in an area of fatigue when printing is performed in the same way.

More preferably, the content of the styryl compound is 8.33 to 16.67 mass % and the content of the triphenylamine compound is 91.67 to 83.33 mass % in the present invention. If the content of the styryl compound is less than 8.33 mass %, there may be too much sensitivity loss when the photoreceptor is left in a bright location, while if it exceeds 16.67 mass %, there may be too much sensitivity gain when the photoreceptor is left in a bright location.

In the photoreceptor of the present invention, it is only essential that the styryl compound and triphenylamine compound be used together as charge transport materials in the photosensitive layer, and there are no particularly limitations on the materials making up the various layers, which may be configured appropriately by ordinary methods.

The conductive substrate 1 serves both as one electrode of the photoreceptor and as a support for the various layers making up the photoreceptor, and may be in any shape such as a disc, plate, film or the like, and of a material such as aluminum, stainless steel, nickel or another metal, or glass or plastic or the like that has been subjected to surface conductive treatment.

The undercoat layer 2 is a layer composed mainly of resin or an alumite or other metal oxide coating, and is provided as necessary in order to control the charge injection properties from the conductive substrate to the photosensitive layer, as well as to cover up defects of the substrate surface and improve the adhesiveness of the photosensitive layer. Polyethylene, polypropylene, polystyrene, acrylic resin, vinyl chloride resin, vinyl acetate resin, polyurethane resin, epoxy resin, polyester resin, melamine resin, silicone resin, polybutyral resin, polyamide resin and copolymers of these and the like can be used individually or mixed in appropriate combinations for the undercoat layer. Metal oxide fine particles or the like may also be included in these resins. Examples of metal oxide fine particles that may be included are $SiO_2$, $TiO_2$, $In_2O_3$, $ZrO_2$ and the like. The thickness of the undercoat layer depends on its composition, and can be set at will within a range at which there are no ill effects such as an increase in residual potential with long-term continuous use.

The charge generation layer 4 is a vacuum-deposited layer of an organic charge generation material, or a coated film of a material containing particles of an organic charge generation material dispersed in a resin binder, and has the function of generating charge in response to light. Both a high charge generating efficiency and the ability to inject the generated charge into the charge transport layer are important, and preferably there is little field dependency and injection performance is good even with a low electrical field. Since the charge generation layer only needs to have the function of charge generation, its thickness is determined by the light absorption coefficient of the charge generation material used, and is ordinarily 5 μm or less, or preferably 1 μm or less. A charge transport material can also be added and used in a charge generation layer made principally of a charge generation material.

Examples of charge generation materials include phthalocyanine pigments, azo pigments, anthanthrone pigments, perylene pigments, perinone pigments, squarilium pigments, thiapyrylium pigments, quinacridone pigments and the like, which can be used alone or mixed and used in appropriate combinations. Examples of resin binders include polycarbonate resin, polyester resin, polyamide resin, polyurethane resin, epoxy resin, polybutyral resin, vinyl chloride copolymer, phenoxy resin, silicone resin, methacrylic acid ester resin and copolymers of these, which can be used alone or mixed and used in appropriate combinations. Of these, titanyl phthalocyanine having clear diffraction peaks at Bragg angles of 7.22°, 9.60°, 11.60°, 13.40°, 14.88°, 18.34°, 23.62°, 24.14° and 27.32° in the CuKα X-ray diffraction spectrum, and having a maximum diffraction peak at a Bragg angle of 9.60°, is preferably used in the present invention from the standpoint of compatibility with the applied printing device. The content of the charge generation material in the charge generation layer 3 is preferably 20 to 80 mass % or more preferably 30 to 70 mass % of the solid component of the charge generation layer 3.

Polymers and copolymers of polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin, methacrylic acid ester resin and the like can be used in suitable combinations for the resin binder of the charge generation layer 4.

The charge transport layer 5 is a coating of a material containing charge transport materials dispersed in a resin binder, and functions as an insulating layer to hold the charge of the photoreceptor in the dark, and for transporting charge injected from the charge generation layer when the photoreceptor receives light. In the present invention, the aforementioned styryl compound and triphenylamine compound must be combined and mixed together as the charge transport materials, but other charge transport materials may also be combined. Examples of charge transport materials that may be combined include pyrazoline compounds, pyrazolone compounds, oxadiazole compounds, arylamine compounds, benzidine compounds, stilbene compounds and hydrazone compounds, as well as styryl compounds other than the aforementioned and polyvinyl carbazole and other charge transport polymers and the like. The content of the charge transport material in the charge transport layer 5 is preferably 10 to 90 mass % or more preferably 20 to 80 mass % of the solid components of the charge transport layer 5.

Polymers and copolymers of polycarbonate resin, polyester resin, polystyrene resin, methacrylic acid ester and the like may be used as the resin binder of the charge transport layer 5, but stable mechanical, chemical and electrical properties and adhesiveness are required as well as compatibility with the charge transport material. The film thickness of the charge transport layer is preferably in the range of 3 to 50 μm or more preferably 10 to 40 μm in order to maintain an effective surface potential for practical use.

A monolayer photosensitive layer is a coating of a material containing a charge generation material and charge transport materials dispersed in a resin binder, and the materials used in the charge generation layer 4 and charge transport layer 5 above may similarly be used. The film thickness is preferably in the range of 3 to 50 μm or more preferably 10 to 40 μm in order to maintain an effective surface potential for practical use. The content of the charge generation material in the monolayer photosensitive layer 3*c* is preferably 0.1 to 20 mass % or more preferably 0.5 to 10 mass % of the solids in the monolayer photosensitive layer 3*c*. The content of the charge transport material in the monolayer photosensitive layer 3*c* is preferably 9.9 to 70 mass % or more preferably 19.5 to 70 mass % of the solids in the monolayer photosensitive layer 3*c*. Moreover, the content of the resin binder in the monolayer photosensitive layer 3*c* is preferably 10 to 90 mass % or more preferably 20 to 80 mass % of the solids in the monolayer photosensitive layer 3*c*.

An electron acceptor may also be included in a photosensitive layer 3*a*, 3*b* or 3*c* such as those discussed above with the aim of improving sensitivity, reducing residual potential or reducing property fluctuation during repeated use. Examples of electron acceptors include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanodimethane, chloranyl, bromanyl, o-nitrobenzoic acid and other compounds with strong electron affinity.

Anti-oxidants, light stabilizers and other deterioration preventers may also be included in the photosensitive layers 3*a*, 3*b* and 3*c* with the aim of improving environmental resistance and stability with respect to harmful light. Compounds that can be used for such purposes include tocopherol and other chromanol derivatives and etherified or esterified compounds thereof, polyaryl alkane compounds, hydroquinone derivatives and etherified or esterified compounds thereof, benzophenone derivatives, benzotriazole derivatives, thioetherified compounds, phenylene diamine derivatives, phosphonic acid esters, phosphorous acid esters, phenol compounds, hindered phenol compounds, linear amine compounds, cyclic amine compounds, hindered amide compounds and the like.

A leveling agent such as silicone oil or fluorine oil may also be included in the photosensitive layer with the aim of improving the leveling properties of the formed film and conferring lubricity. Moreover, fine particles of a metal oxide such as silicon oxide (silica), titanium oxide, zinc oxide, calcium oxide, aluminum oxide (alumina) or zirconium oxide, a metal sulfide such as barium sulfide or calcium sulfide, or a metal nitride such as silicon nitride or aluminum nitride, or fluorine resin particles of ethylene tetrafluoride resin or the like, or a fluorine comb graft polymer resin or the like may be included with the aim of adjusting film hardness, reducing the friction coefficient, conferring lubricity and the like. Other known additives may also be included to the extent that they do not greatly detract from the electrophotographic properties.

The surface protective layer 6, which is provided as necessary, is composed of a substance that is chemically stable and has excellent resistance to mechanical stress, and needs to have the function of receiving and holding charge from corona discharge or the like in the dark, as well as the property of transmitting the light to which the charge generation layer is sensitive, so that it can transmit light to the charge generation layer during exposure of the photoreceptor, accept injections of generated charge, and neutralize and reduce surface charge. The material making up the surface protective layer may be a denatured silicone resin such as acrylic denatured silicone resin, epoxy denatured silicone resin, alkyd denatured silicone resin, polyester denatured silicone resin, urethane denatured silicone resin or the like, or a silicone resin used as a hard coating agent. These materials may be used individually, but durability is improved when they are mixed with a condensed product of a metal alkoxy compound having coat-forming properties and composed primarily of $SiO_2$, $TiO_2$ or $In_2O_3$. The thickness of the surface protective layer depends partly on the combination of constituent materials, and can be set at will within the range at which there are no adverse effects on the photoreceptor properties, such as an increase in residual potential during long-term continuous use.

The photoreceptor is manufactured according to its configuration by sequentially stacking the various layers as discussed above on the conductive substrate 1. Each layer is formed by dispersing and dissolving the respective constituent materials of the layer in an appropriate organic solvent to form a coating solution, which is then coated by an ordinary method such as dip coating, and dried. Depending on the charge generation material used, the charge generation layer may also be formed by a vacuum deposition method.

The desired effects of the electrophotographic photoreceptor of the present invention are obtained when it is applied to various machine processes. Specifically, satisfactory effects can be obtained in development processes including charging processes such as contact charging systems using rollers and brushes and non-contact charging systems using corotrons, scorotrons and the like, as well as contact and non-contact development processes using non-magnetic one-component, magnetic one-component, two component and other developing systems and the like.

EXAMPLES

The present invention is explained in detail below using examples. In the examples, "parts" represent mass parts, while "%" means mass %.

Example 1

The outer circumference of an aluminum cylinder with an outer diameter of 30 mm and a length of 260.5 mm was dip coated with a coating solution obtained by dispersing and dissolving 5 parts of alcohol-soluble polyamide (Toray Industries, Inc., trade name "CM8000") and 11 parts of aminosilane-treated titanium oxide fine particles in a mixed solvent of methanol, methylene chloride and butanol (mixing ratio 3/5/2), and dried for 20 minutes at 140° C. to form an 1.5 μm-thick undercoat layer.

A coating solution obtained by dispersing and dissolving 1 part of titanyl phthalocyanine having clear diffraction peaks at Bragg angles of 7.22°, 9.60°, 11.60°, 13.40°, 14.88°, 18.34°, 23.62°, 24.14° and 27.32° and having a maximum diffraction peak at a Bragg angle of 9.60° in the CuKα X-ray diffraction spectrum (described in Japanese Patent Application Publication No. H8-209023) as a charge generation material and 1 part of vinyl chloride copolymer resin (ZEON CORPORATION, trade name "MR-110") as a resin binder in 98 parts of methylene chloride was dip coated on this undercoat layer, and dried for 15 minutes at 80° C. to form an 0.3 μm-thick charge generation layer.

A coating solution obtained by dispersing and dissolving 0.1 parts (1.67% as a mass percentage of the total charge transport materials in the photosensitive layer) of the styryl compound represented by structural formula (I) above (TAKASAGO CHEMICAL CORPORATION, trade name "T-328") and 5.9 parts of the triphenylamine compound represented by structural formula (II) above (TAKASAGO CHEMICAL CORPORATION, trade name "T-716") as charge transport materials together with 14 parts of polycarbonate resin as a binder resin (Mitsubishi Engineering-Plastics Corporation, trade name "S-3000N") in 76 parts of methylene chloride was dip coated on this charge generation layer, and dried for 60 minutes at 90° C. to form a charge transport layer with a thickness of 29 μm and prepare a photoreceptor with the configuration shown in FIG. 1.

Example 2

A photoreceptor was prepared as in Example 1 except that 0.5 parts (8.33% as a mass percentage of the total charge transport materials in the photosensitive layer) of the styryl compound represented by structural formula (I) above (TAKASAGO CHEMICAL CORPORATION, trade name "T-328") and 5.5 parts of the triphenylamine compound represented by structural formula (II) above (TAKASAGO CHEMICAL CORPORATION, trade name "T-716") were used as charge transport materials.

Example 3

A photoreceptor was prepared as in Example 1 except that 1 part (6.67% as a mass percentage of the total charge transport materials in the photosensitive layer) of the styryl compound represented by structural formula (I) above (TAKASAGO CHEMICAL CORPORATION, trade name "T-328") and 5 parts of the triphenylamine compound represented by structural formula (II) above (TAKASAGO CHEMICAL CORPORATION, trade name "T-716") were used as charge transport materials.

Example 4

An undercoat layer and charge generation layer were formed sequentially as in Example 1 on the outer surface of an aluminum cylinder with an outer diameter of 30 mm and a length of 260.5 mm. The charge generation layer was then dip coated with a coating solution obtained by dispersing and dissolving 0.1 parts (1.25% as a mass percentage of the total charge transport materials in the photosensitive layer) of the styryl compound represented by structural formula (I) above (TAKASAGO CHEMICAL CORPORATION, trade name "T-328") and 7.9 parts of the triphenylamine compound represented by structural formula (II) above (TAKASAGO CHEMICAL CORPORATION, trade name "T-716") as charge generation materials together with 12 parts of a polycarbonate resin as a binder resin (TEIJIN LIMITED, trade name "TS2050") in 105 parts of methylene chloride, and dried for 60 minutes at 90° C. to form a charge transport layer with a thickness of 26 μm and prepare a photoreceptor with the configuration shown in FIG. 1.

Example 5

A photoreceptor was prepared as in Example 4 except that 0.5 parts (6.25% as a mass percentage of the total charge transport materials in the photosensitive layer) of the styryl compound represented by structural formula (I) above (TAKASAGO CHEMICAL CORPORATION, trade name "T-328") and 7.5 parts of the triphenylamine compound represented by structural formula (II) above (TAKASAGO CHEMICAL CORPORATION, trade name "T-716") were used as charge transport materials.

Example 6

A photoreceptor was prepared as in Example 4 except that 1 part (12.6% as a mass percentage of the total charge transport materials in the photosensitive layer) of the styryl compound represented by structural formula (I) above (TAKASAGO CHEMICAL CORPORATION, trade name "T-328") and 7 parts of the triphenylamine compound represented by structural formula (II) above (TAKASAGO CHEMICAL CORPORATION, trade name "T-716") were used as charge transport materials.

Example 7

A photoreceptor was prepared as in Example 4 except that 5 parts (50.0% as a mass percentage of the total charge transport materials in the photosensitive layer) of the styryl compound represented by structural formula (I) above (TAKASAGO CHEMICAL CORPORATION, trade name "T-328") and 5 parts of the triphenylamine compound represented by structural formula (II) above (TAKASAGO CHEMICAL CORPORATION, trade name "T-716") were used as charge transport materials.

Comparative Example 1

A photoreceptor was prepared as in Example 1 except that 6 parts of the triphenylamine compound represented by structural formula (II) above (TAKASAGO CHEMICAL CORPORATION, trade name "T-716") were used alone as the charge transport material.

Comparative Example 2

A photoreceptor was prepared as in Example 4 except that 8 parts of the triphenylamine compound represented by structural formula (II) above (TAKASAGO CHEMICAL CORPORATION, trade name "T-716") were used alone as the charge transport material.

The initial electrical characteristics and light-induced fatigue characteristics of the various photoreceptors prepared as discussed above were evaluated using a photoreceptor drum electric property evaluation device. For the electrical characteristics, the photoreceptor was mounted on the evaluation device, the photoreceptor surface was charged to about −650 V by corona discharge with a corotron system in the dark, and the band potential V0 was measured, after which corona discharge was stopped, the photoreceptor was left for about 5 seconds in the dark, the surface potential VD5 was measured, and the potential retention rate VK5 [(V0−VD5)/V0)×100] (%) was determined. Similarly, the photoreceptor surface was charged until the band potential V0 was about −650 V, and exposed to light at wavelength 780 nm, 10N/cm$^2$, and the amount of exposure E ½ (sensitivity) required to reduce the surface band potential from about −650 V to −325 V, the amount of exposure E100 (sensitivity) required to reduce the band potential to 100 V, and the residual potential VR5 (surface potential with 5 second's exposure) were measured. These measurement results are shown in Table 1 below.

TABLE 1

| | Styryl compound content (%) | VK5 (%) | E ½ (μJ/cm$^2$) | E100 (μJ/cm$^2$) | VR5 (−V) |
|---|---|---|---|---|---|
| Ex. 1 | 1.67 | 97.7 | 0.099 | 0.406 | 39 |
| Ex. 2 | 8.33 | 97.4 | 0.098 | 0.367 | 34 |
| Ex. 3 | 16.67 | 97.2 | 0.098 | 0.362 | 34 |
| CE 1 | 0 | 97.8 | 0.098 | 0.380 | 39 |
| Ex. 4 | 1.25 | 93.8 | 0.103 | 0.503 | 43 |
| Ex. 5 | 6.25 | 94.1 | 0.107 | 0.498 | 43 |
| Ex. 6 | 12.5 | 94.0 | 0.097 | 0.520 | 47 |
| Ex. 7 | 50 | 93.9 | 0.099 | 0.406 | 38 |
| CE 2 | 0 | 94.4 | 0.106 | 0.468 | 40 |

Next, the light-induced fatigue characteristics were evaluated as follows. First, black paper with a window of dimensions 20 mm (circumferential direction)×40 mm (axial direction) was wrapped around the outer circumference of the photoreceptor, forming a part exposed and part not exposed to light from a fluorescent lamp. The photoreceptor was then positioned with the window in the black paper facing up, the window was exposed for 120 minutes to the fluorescent lamp at an intensity of 1000 lux/sec, and the VL characteristics of the photoreceptor were measured immediately after exposure. VL potential was measured by mounting the photoreceptor on the evaluation device, rotating the photoreceptor while charging it until the potential of the photoreceptor surface reached about −600 V, and then exposing it to light at wavelength 780 nm, 0.6 0μJ/cm$^2$ and measuring the bright area potential VL. The light-induced fatigue characteristics were evaluated based on the potential difference between the exposed area and non-exposed area in the circumferential direction of the photoreceptor.

Figure 4:
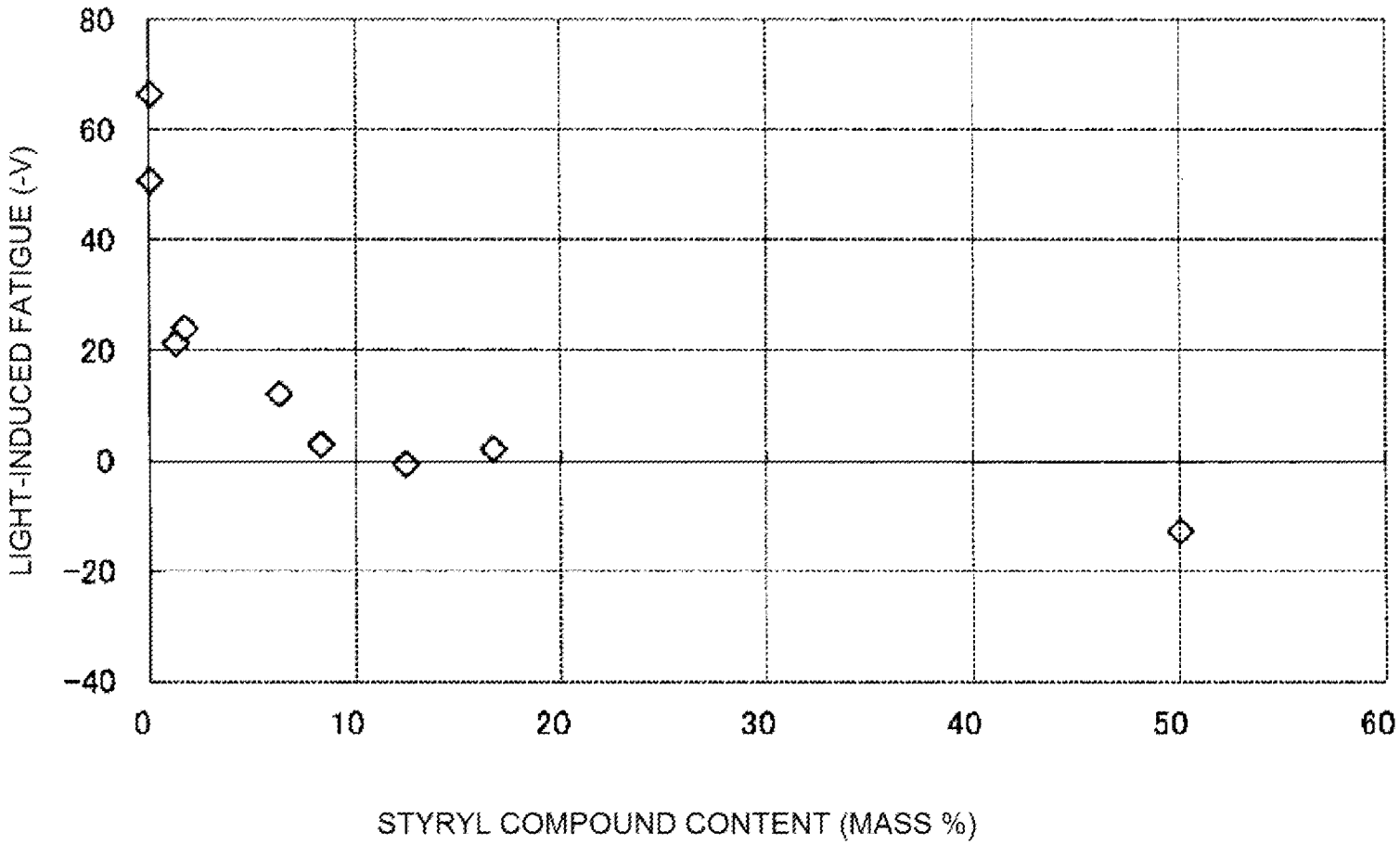
FIG. 4 is a graph showing the relationship between styryl compound content and light-induced fatigue in the photoreceptors of the examples.

After undergoing the light-induced fatigue evaluation, the photoreceptor was used to print a halftone image with a concentration of 30% on a Hewlett Packard LJ4350 printer, and printing quality was verified. These evaluation results are shown in Table 2 below. The relationship between styryl compound content and light-induced fatigue is shown in FIG. 4 for each receptor.

TABLE 2

| | Styryl | Bright part potential (−V) | | | |
|---|---|---|---|---|---|
| | compound content (%) | Non-exposed part | Exposed part | Light-induced fatigue (−V) | Printing characteristics (memory Y/N) |
| Ex. 1 | 1.67 | 73.9 | 98 | 24.1 | No |
| Ex. 2 | 8.33 | 67.7 | 70.8 | 3.1 | No |
| Ex. 3 | 16.67 | 67.3 | 69.5 | 2.2 | No |
| CE 1 | 0 | 68.7 | 135 | 66.3 | Negative memory |
| Ex. 4 | 1.25 | 79.7 | 101 | 21.3 | No |
| Ex. 5 | 6.25 | 77.9 | 90 | 12.1 | No |
| Ex. 6 | 12.5 | 110.4 | 110 | −0.4 | No |
| Ex. 7 | 50 | 98.7 | 86 | −12.7 | No |
| CE 2 | 0 | 74.2 | 125 | 50.8 | Negative memory |

As seen in Table 1 above, there were no significant differences between the photoreceptors of the examples and the photoreceptors of the comparative examples in terms of potential retention rate VK5, sensitivity E ½ and E100 and residual potential Vr5.

As shown in Table 2 above and FIG. 4, however, in comparison with the photoreceptors of the examples, the potential difference between the exposed part and non-exposed part was 50 V or more in the photoreceptors of Comparative Example 1 and Comparative Example 2 using a triphenylamine compound alone as the charge transport material, and the shape of the illuminated area appeared as negative memory in a halftone printed image with a 30% concentration.

This confirms that the problem of memory in the exposed part of an actual printed image does not occur when the mass ratio of the styryl compound as a percentage of the charge transport materials is 1.25% or more. Moreover, it was shown that light-induced fatigue tends to stabilize at about 20 V or less when the mass ratio of the styryl compound is 50% or more. In addition, it was shown that a mass ratio of the styryl compound in the range of 8.33% to 16.7% provides good characteristics, with a potential difference of ±10 V due to light-induced fatigue.

Conventionally, styryl compounds have been used for their superior charge transport properties, in order to obtain highly sensitive photoreceptors for use in high-speed copiers and printers, but these results confirm that by adjusting the content of the styryl compound in the photoreceptor of the invention, it is possible to control costs while obtaining an electrophotographic photoreceptor with little light-induced fatigue and good printing quality.

While the present invention has been described in conjunction with embodiments and variations thereof, one of ordinary skill, after reviewing the foregoing specification, will be able to effect various changes, substitutions of equivalents and other alterations without departing from the broad concepts disclosed herein. It is therefore intended that Letters Patent granted hereon be limited only by the definition contained in the appended claims and equivalents thereof.

What is claimed is:

1. An electrophotographic photoreceptor, comprising:

a conductive substrate; and a photosensitive layer provided on the conductive substrate and comprised of an organic photoconductive material, and charge transport materials including a styryl compound represented by structural formula (I) below and a triphenylamine compound represented by structural formula (II) below:

(I)

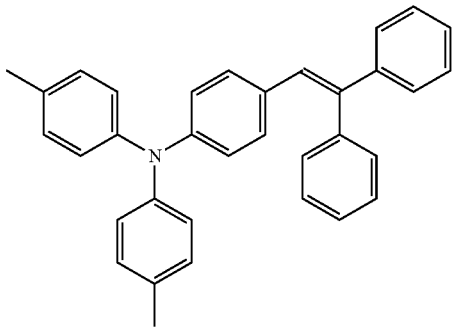

(II)

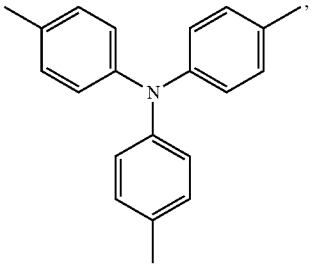

wherein the charge transport materials have a mixing ratio of from 8.33 to 16.67 mass % of the styryl compound to from 91.67 to 83.33 mass % of the triphenylamine compound.

2. The electrophotographic photoreceptor according to claim 1, wherein the photosensitive layer further comprises a charge generation material comprised of titanyl phthalocyanine having clear diffraction peaks at Bragg angles of 7.22°, 9.60°, 11.60°, 13.40°, 14.88°, 18.34°, 23.62°, 24.14° and 27.32° in the CuKα X-ray diffraction spectrum, and having a maximum diffraction peak at a Bragg angle of 9.60°.

* * * * *